US008037622B2

(12) United States Patent
Lin

(10) Patent No.: US 8,037,622 B2
(45) Date of Patent: Oct. 18, 2011

(54) CUSHION IMPROVED STRUCTURE OF SHOE VENTILATING INSOLE

(76) Inventor: Chung-Jen Lin, Huwei Township, Yunlin County (TW)

( * ) Notice: Subject to any disclaimer, the term of this patent is extended or adjusted under 35 U.S.C. 154(b) by 847 days.

(21) Appl. No.: 12/076,900

(22) Filed: Mar. 25, 2008

(65) Prior Publication Data

US 2009/0119953 A1 May 14, 2009

(51) Int. Cl.
*A43B 7/06* (2006.01)

(52) U.S. Cl. ..... 36/3 B; 36/44

(58) Field of Classification Search ..... 36/3 B, 36/44, 43

See application file for complete search history.

(56) References Cited

U.S. PATENT DOCUMENTS

| | | | | |
|---|---|---|---|---|
| 3,716,930 | A * | 2/1973 | Brahm | 36/3 B |
| 4,336,661 | A * | 6/1982 | Medrano | 36/44 |
| 4,760,655 | A * | 8/1988 | Mauch | 36/44 |
| 5,400,526 | A * | 3/1995 | Sessa | 36/3 B |
| 6,581,303 | B1 * | 6/2003 | Tuan | 36/3 B |
| 7,805,858 | B2 * | 10/2010 | Bray et al. | 36/44 |
| 2006/0096123 | A1 * | 5/2006 | Grandini | 36/3 B |
| 2006/0265900 | A1 * | 11/2006 | Lin | 36/3 B |
| 2007/0000148 | A1 * | 1/2007 | Lin et al. | 36/3 B |
| 2007/0011908 | A1 * | 1/2007 | Huang et al. | 36/3 B |
| 2007/0074424 | A1 * | 4/2007 | Lin | 36/44 |

* cited by examiner

*Primary Examiner* — Ted Kavanaugh

(74) *Attorney, Agent, or Firm* — Jackson IPG PLLC; Demian K. Jackson

(57) ABSTRACT

A cushion improved structure of shoe ventilating insole comprises a top insole having air inlet and outlet ports, a bottom insole and a middle smaller area foam pad, wherein said top insole adhered with a cloth or leather and made of plastic material is integrally formed with a raised face on top of the heel area at the top surface thereof, and a plurality of air inlet ports are made at lower peripheral edge of said raised face, further, several grooves in any arbitrary shapes having a plurality of air outlet ports at the inside bottoms thereof is integrally made on the front sole area, and a larger density foam pad is distributingly punched with several small holes while unpressed arch area of foot is densely punched with several big holes, whereby the enhanced smooth air flow and best air change effect due to increased air volume are obtained.

11 Claims, 4 Drawing Sheets

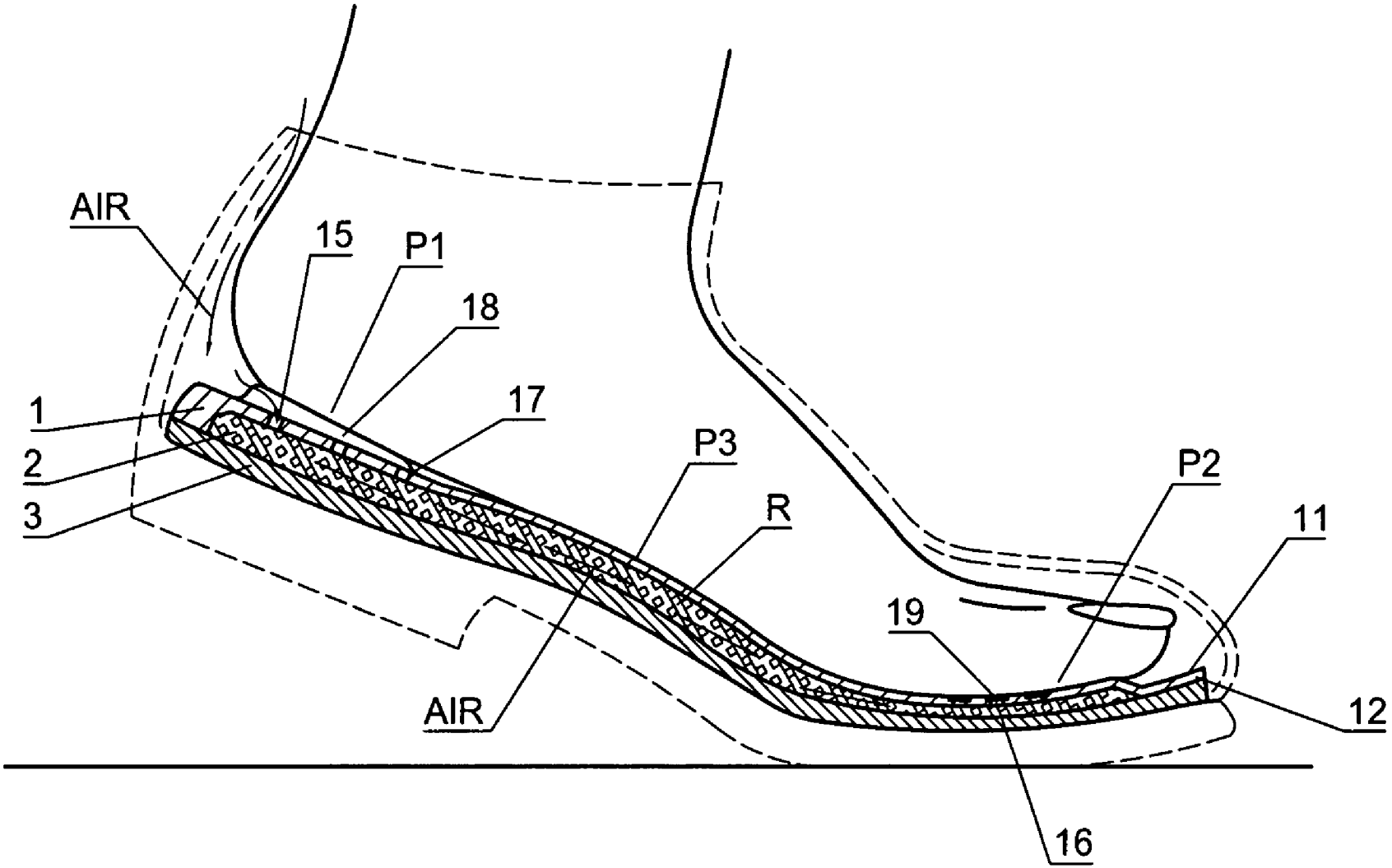
Fig. 3-A

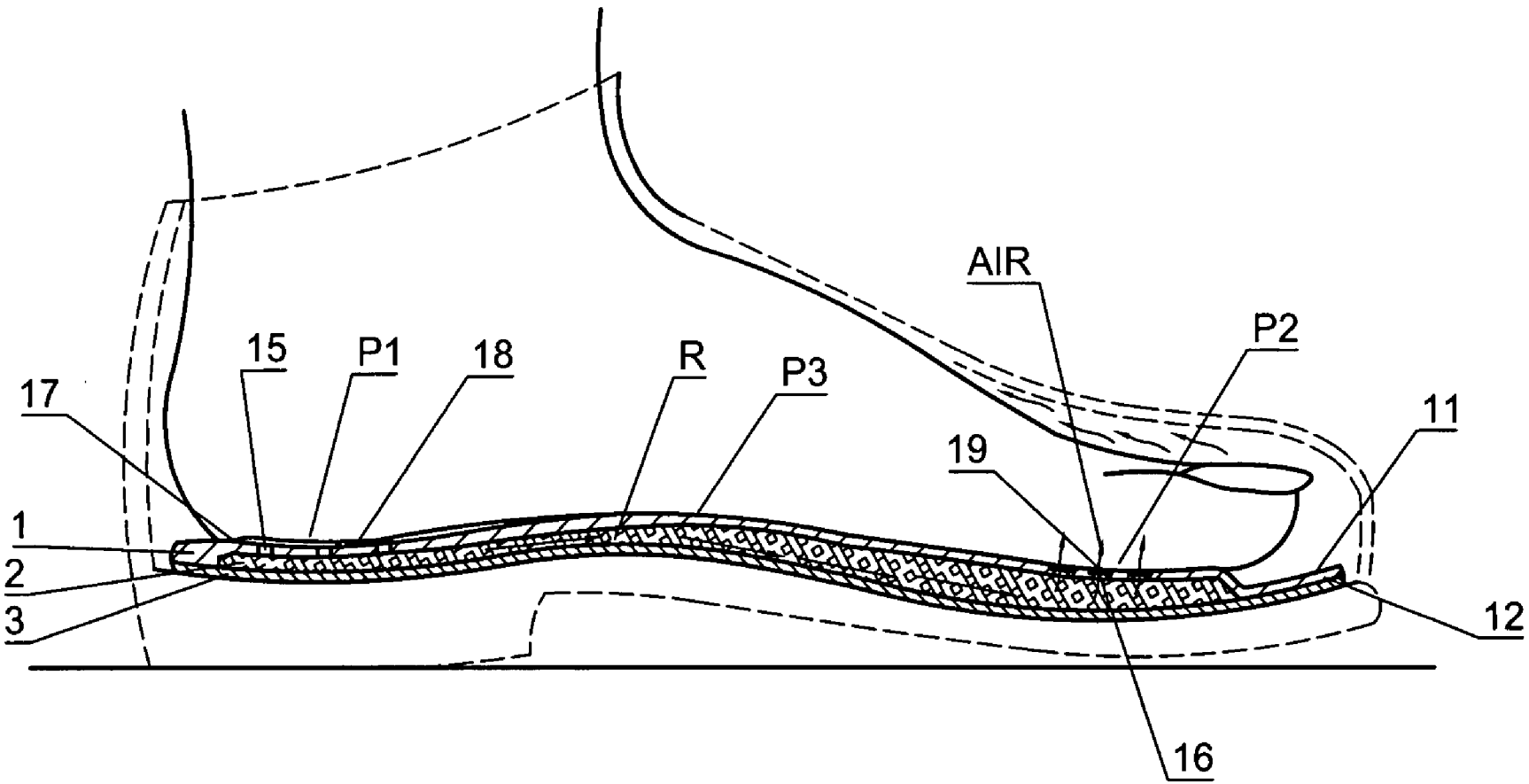
Fig. 3-B

CUSHION IMPROVED STRUCTURE OF SHOE VENTILATING INSOLE

BACKGROUND OF THE INVENTION (a) Field of the Invention

A cushion improved structure of shoe ventilating insole is a flexible insole which comprises a top insole having improved air inlet and outlet ports, a bottom insole and a middle smaller area foam pad, a raised face is integrally made on top of the heel area at the top surface of said top insole, and a plurality of air inlet ports are made at lower peripheral edge of said raised face, further, several grooves in any arbitrary shapes having a plurality of air outlet ports at the inside bottoms thereof is integrally made on the front sole area, and a larger density and anti-compressive foam pad is distributingly punched with several small holes while the unpressed arch area of foot is densely punched with several big holes, whereby through said structure, air flow and air change effects are significantly strengthened.

(b) Description of the Prior Art

A ventilating insole has a air bladder, wherein the top insole above the air bladder is made with an air inlet port at heel area thereof, and made with several air outlet ports at the front sole area thereof.

Prior patents for ventilating insole can be referred to U.S. Pat. No. 4,215,492, Aug. 5, 1980; U.S. Pat. No. 5,010,661, May 30, 1991; U.S. Pat. No. 5,333,397, Aug. 2, 1994; U.S. Pat. No. 4,224,746, Sep. 30, 1980; WO 97/04676A1, Feb. 13, 1997; and China Utility Model patent No. 925176, Jul. 18, 2007, etc.

Prior patents for insole internal air bladder to be insertingly installed with foam pad (or sponge pad) can be referred to U.S. Pat. No. 4,224,746, Sep. 30, 1980; U.S. Pat. No. 6,006, 447, Dec. 28, 1999; WO 97/04676A1; and China Utility Model patent No. 925176, Jul. 18, 2007, etc.

However, regarding known ventilating insole structure on the streets and in the prior patents, if the top insole is made to a level plane, then when the foot is raised above ground, air inlet ports are easily covered by heel of the foot for a tight shoe, so air is difficult to flow in air bladder through said air inlet ports; on the other hand, when the insole is pressed by the foot, if the air outlet ports are covered by front sole of the foot, air inside air bladder is difficult to flow out from the air outlet ports, thereby the imperfections of unsmooth air flow are commonly found in everywhere.

In addition, if said air bladder of ventilating insole structure is constituted by the top and bottom insoles and a middle foam pad, wherein if the foam pad with large porosity and low density is used, although it has a larger air volume, it is easily squelched due to elastic fatigue, on the contrary, if a foam pad with small porosity and larger density is used, although it is advantageous to have a good elasticity and therefore is not easily squelched, however, its air flow is unsmooth due to smaller air volume and there is other imperfections such as heat source generated by impingement and friction when air is flowed through the larger density foam pad.

SUMMARY OF THE INVENTION

The main purpose of the invention is to disclose a cushion improved structure of shoe ventilating insole, wherein it is characterized in that a raised surface of a gentle cone or other cylindrical or cone shaped bodies is installed on top of the heel area at the top surface of top insole in contact with sole of the foot is matchingly made with air inlet ports at lower peripheral edges thereof, when the shoe wearer raises his foot above ground, as heel of the foot is pushed against by the overhead raised face, air inlet ports are not covered up by heel of the foot so that air can be allowed to enter air bladder through air inlet ports thereby to achieve an active air change effect.

The second purpose of the invention is to disclose a cushion improved structure of shoe ventilating insole, wherein it is characterized in that wherein several grooves having a plurality of air outlet ports at the inside bottoms thereof, when the shoe wearer is walking and his foot is pressing on the insole, air outlet ports are not covered up by front sole of the foot, so that air inside air bladder is easy to flow out through air outlet ports thereby to achieve an active effect of smooth air change.

The third purpose of the invention is to disclose a cushion improved structure of shoe ventilating insole, wherein it is characterized in that a small porosity and larger density foam pad is distributingly punched with several small holes while the unpressed arch area of foot is densely punched with several big holes to increase air volume for convenience of air flow thereby to achieve a large flow of air change.

BRIEF DESCRIPTION OF THE DRAWINGS

FIG. 1-A is a perspective view showing the top surface of top insole as in FIG. 1.

FIG. 1-B is a perspective view showing the decomposition of another embodiment of the top insole as shown in FIG. 1-A.

FIG. 2-A is a perspective view showing top surface of the top insole as shown in FIG. 2.

FIG. 3-A is a sectional schematic view showing air inlet at heel area as shown in FIG. 1.

FIG. 3-B is a sectional schematic view showing air outlet at front sole area as shown in FIG. 1.

DETAIL DESCRIPTION OF THE PREFERRED EMBODIMENTS

Figure 1:
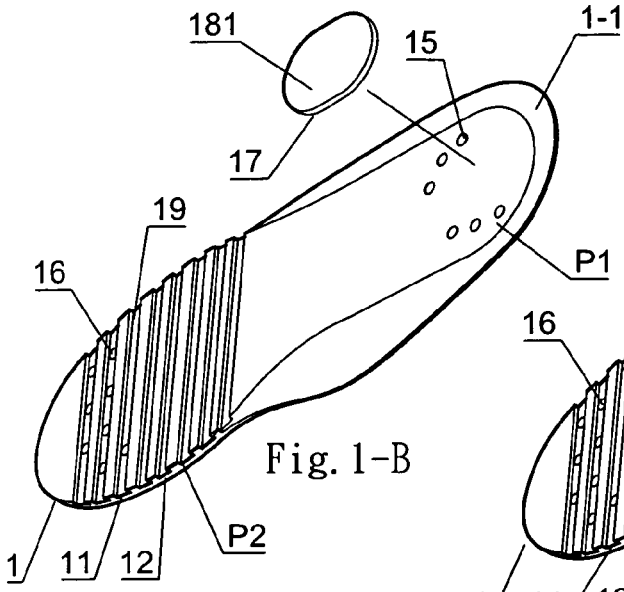
FIG. 1 is a perspective view showing the decomposition of a cup type ventilating insole structure of the invention.
Figure 1:
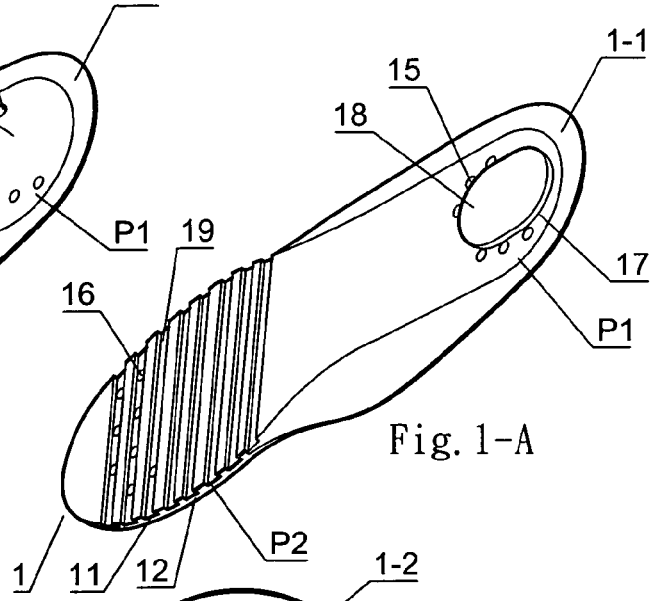
Figure 1:
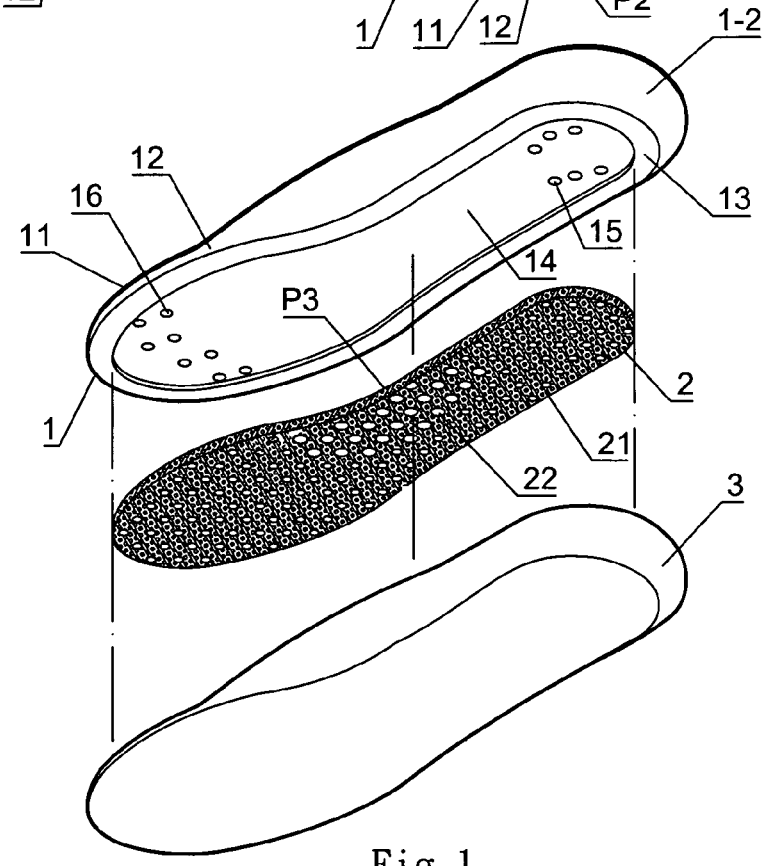
Figure 2:
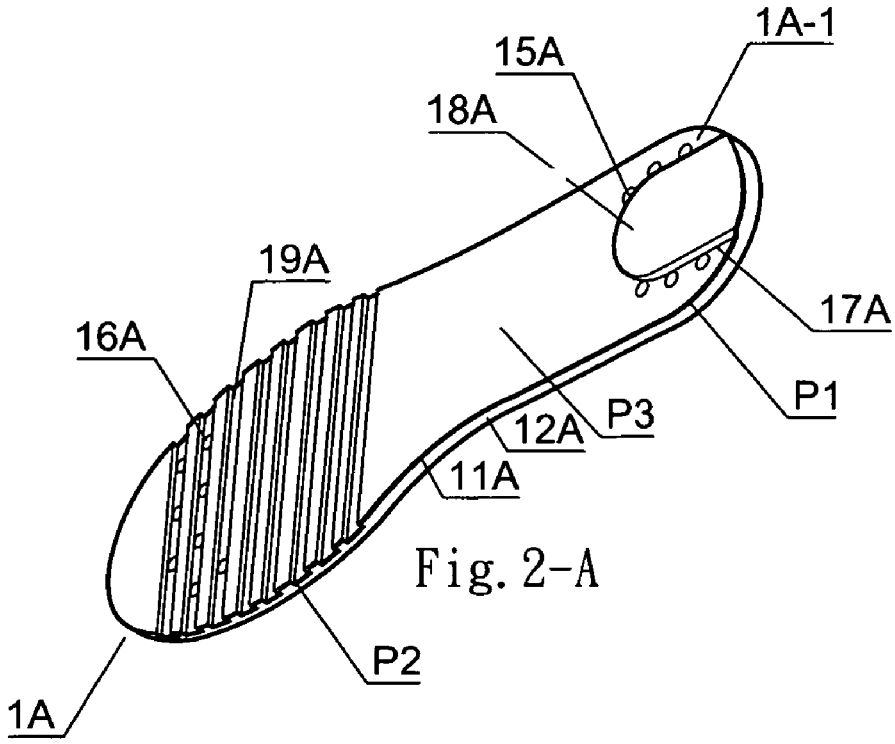
FIG. 2 is a perspective view showing the decomposition of the plane ventilating insole structure of the invention.
Figure 2:
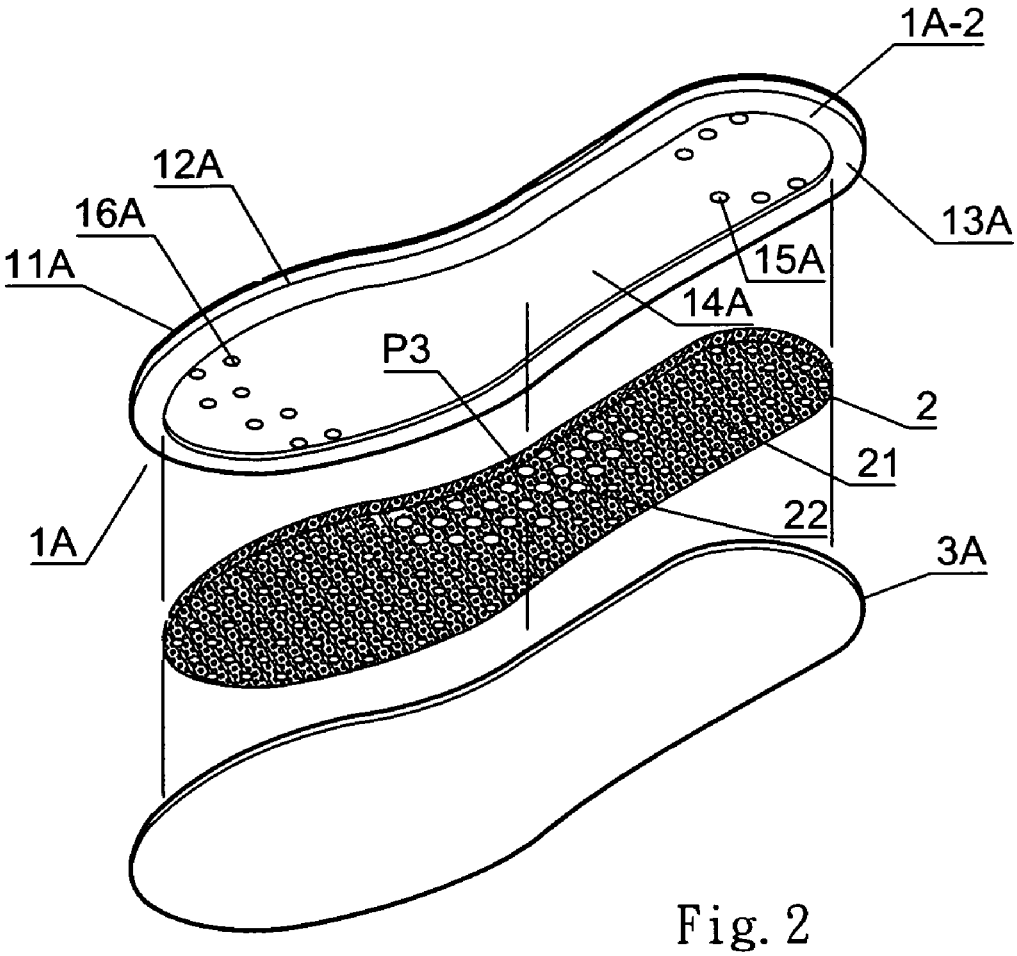

The embodiments and application examples of the disclosed invention are described along with accompanying Figs. herein, and reference is made to FIG. 1, FIG. 1-A, FIG. 2, FIG. 2-A first:

It is clearly understood that the invention mainly comprises an integrally formed top insole 1, 1A made of plastic material 12, 12A being capable of adhering a cloth or leather 11, 11A on the surface thereof, a raised face 18, 18A is installed on top of the heel area at the top surface 1-1, 1A-1 thereof, and a plurality of air inlet ports 15, 15A are made at peripheral edge 17, 17A of said raised face 18, 18A, wherein said raised face 18,18A can be a gentle cone (as shown in FIG. 1-A) or other cylindrical or cone shaped bodies (as shown in FIG. 2-A).

In which, the raised face 18, 18A can be integrally formed with top insole 1, 1A, or raised piece 181 can be pasted on the heel area of top insole 1, 1A for a raise installation (as shown in FIG. 1-B) to obtain the same effect as of integrally formed raised face 18 as shown in FIG. 1-A.

Further, several grooves 19, 19A having a plurality of air outlet ports 16, 16A at the inside thereof is integrally made on the front sole area P2 of the front section at the top surface 1-1, 1A-1 of said top insole 1 and a containing space 14, 14A forming with frame 13, 13A at the surrounding thereof for housing a foam pad 2 having flexibility, porosity and ventilation to be constituted by foam products of different material is integrally concavely made at the center area of bottom surface 1-2, 1A-2 of said insole 1.

Furthermore, said frame 13, 13A formed at the surrounding of said containing space 14, 14A is stickily adhered with bottom insole 3, thereby the bottom insole 3, 3A and the frame 13, 13A formed at the surrounding of bottom surface 1-2, 1A-2 of said top insole 1 are adhered together to form an air bladder R for insole ventilation (refer to FIGS. 3-A, 3-B).

Through above said structure as shown in FIG. 3-A for the case of the shoe wearer to walk with the improved ventilation insole of the invention, wherein when the shoe wearer raises his foot above ground, as heel of the foot P1 is pushed against by the overhead raised face 18, air inlet ports 15 are not covered up by heel of the foot P1 so that a large volume of air (AIR) is allowed to enter air bladder R through air inlet ports 15 thereby to achieve an active air change effect.

Further as shown FIG. 3-B for the case of the shoe wearer to walk with the improved ventilating insole of the invention, wherein when the shoe wearer is walking and his foot is pressing on the insole, the overhead grooves 19 then prevents the air outlet ports 16 from being covered up by front sole of the foot P2, so that air (AIR) inside air bladder R is easy to flow out through air outlet ports 16 thereby to achieve a smooth air change effect.

Further as shown in FIGS. 3-A, 3-B: A foam pad 2 with smaller porosities and higher density can be adopted for the ventilating insole of the invention, wherein said foam pad 2 is distributingly punched with several small holes 21 while the unpressed arch area of foot P3 can be densely punched with several big holes 22 to increase air volume during continuous pressing and recovery process of foam pad 2 and to be more helpful for air flow increase thereby to achieve a large flow of air change.

I claim:

1. A cushion improved structure of shoe ventilating insole comprises:

a top insole having air inlet and outlet ports being made of plastic material, a bottom insole and a middle smaller area foam pad, wherein it is characterized in that a raised face is integrally formed on a top of the heel area at the top surface of said top insole, and a plurality of air inlet ports are made at a lower peripheral edge of said raised face to form two lines of air inlet ports, each line of air inlet ports being located on opposite sides of said raised face, further, several grooves having a plurality of air outlet ports are integrally made on a bottom of a front sole area of said top insole, whereby a smooth air change through said air inlet and outlet ports are not obstructed by user's pressing foot during an air change flow process due to said raised face preventing the user's foot from covering said plurality of air inlet ports located at said lower peripheral edge of said raised face.

2. The cushion improved structure of shoe ventilating insole as claimed in claim 1, wherein it is characterized in that said raised face installed on top of the heel area at the top surface of top insole in contact with sole of the foot can be a gentle cone or other cylindrical or cone shaped bodies applicable for providing a overhead effect for said air inlet ports made at the lower peripheral edges thereof.

3. The cushion improved structure of shoe ventilating insole as claimed in claim 1, wherein it is characterized in that said grooves made at the front sole area of the top surface of top insole in contact with sole of the foot can be of any arbitrary shapes and quantities applicable for providing an overhead effect for air outlet ports made at the lower locations thereof.

4. The cushion improved structure of shoe ventilating insole as claimed in claim 1, wherein it is characterized in that said middle smaller area foam pad insertingly installed between top insole and bottom insole can be constituted by a flexible, porous and ventilating foam product with a larger density, wherein said foam pad is distributingly punched with several small holes while the unpressed arch area of foot is densely punched with several big holes to increase air volume during continuous pressing and recovery process of foam pad and to be more helpful for air flow increase thereby to achieve a large flow of air change.

5. The cushion improved structure of shoe ventilating insole as claimed in claim 1, wherein an air bladder is located beneath said top insole and extends to underlie both said heel area and said front sole area of said top insole, said air bladder linking the plurality of air inlet ports and the plurality of air outlet ports so that the smooth air change through said air inlet and outlet ports is effectuated by a user's pressing foot during the air change flow process.

6. A cushion improved structure of shoe ventilating insole comprises:

a top insole having air inlet and outlet ports being made of plastic material, a bottom insole and a middle smaller area foam pad, wherein it is characterized in that a raised piece is installed on a top of the heel area at the top surface of said top insole, and a plurality of air inlet ports are made at a lower peripheral edge of said raised face to form two lines of air inlet ports, each line of air inlet ports being located on opposite sides of said raised piece, further, several grooves having a plurality of air outlet ports are integrally made on a bottom of a front sole area of the top insole, whereby a smooth air change through said air inlet and outlet ports are not obstructed by user's pressing foot during an air change flow process due to said raised piece preventing the user's foot from covering said plurality of air inlet ports located at said lower peripheral edge of said raised piece.

7. The cushion improved structure of shoe ventilating insole as claimed in claim 6, wherein it is characterized in that said raised piece can be pasted on the heel area of top insole for a raised installation.

8. The cushion improved structure of shoe ventilating insole as claimed in claim 6, wherein it is characterized in that said raised piece installed on top of the heel area at the top surface of top insole in contact with sole of the foot can be a gentle cone or other cylindrical or cone shaped bodies applicable for providing a overhead effect for said air inlet ports made at the lower peripheral edges thereof.

9. The cushion improved structure of shoe ventilating insole as claimed in claim 6, wherein it is characterized in that said grooves made at the front sole area of the top surface of top insole in contact with sole of the foot can be of any arbitrary shapes and quantities applicable for providing an overhead effect for air outlet ports made at the lower locations thereof.

10. The cushion improved structure of shoe ventilating insole as claimed in claim 6, wherein it is characterized in that said middle smaller area foam pad insertingly installed between top insole and bottom insole can be constituted by a flexible, porous and ventilating foam product with a larger density, wherein said foam pad is distributingly punched with several small holes while the unpressed arch area of foot is densely punched with several big holes to increase air volume during continuous pressing and recovery process of foam pad and to be more helpful for air flow increase thereby to achieve a large flow of air change.

11. The cushion improved structure of shoe ventilating insole as claimed in claim 6, wherein an air bladder is located beneath said top insole and extends to underlie both said heel area and said front sole area of said top insole, said air bladder linking the plurality of air inlet ports and the plurality of air outlet ports so that the smooth air change through said air inlet and outlet ports is effectuated by a user's pressing foot during the air change flow process.

* * * * *